US007496312B2

(12) United States Patent
Sato et al.

(10) Patent No.: US 7,496,312 B2
(45) Date of Patent: Feb. 24, 2009

(54) AUXILIARY POWER SUPPLY UNIT AND IMAGE FORMING APPARATUS

(75) Inventors: Naoki Sato, Kanagawa (JP); Keiichi Sugai, Miyagi (JP); Masae Sugawara, Miyagi (JP); Masashi Oi, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 377 days.

(21) Appl. No.: 11/192,026

(22) Filed: Jul. 29, 2005

(65) Prior Publication Data

US 2006/0024079 A1 Feb. 2, 2006

(30) Foreign Application Priority Data

Aug. 2, 2004 (JP) ..... 2004-225619
Jul. 11, 2005 (JP) ..... 2005-202153

(51) Int. Cl.
*G03G 15/00* (2006.01)

(52) U.S. Cl. ..... 399/88

(58) Field of Classification Search ..... 399/37, 399/67, 69, 88, 90, 122, 320, 330; 219/216; 307/48, 49, 64, 66; 315/86
See application file for complete search history.

(56) References Cited

U.S. PATENT DOCUMENTS 4,504,139 A * 3/1985 Nozaki et al. ..... 399/88
4,771,312 A * 9/1988 Yanase et al. ..... 399/88
5,073,751 A * 12/1991 Kaitandjian et al. ..... 320/166
5,793,124 A 8/1998 Mitzaki
5,982,050 A * 11/1999 Matsui ..... 307/10.7
6,542,705 B2 * 4/2003 Fujita et al. ..... 399/69
6,809,433 B2 10/2004 Nozu
6,987,936 B2 * 1/2006 Satoh et al. ..... 399/88
2004/0149740 A1 8/2004 Kishi et al.

FOREIGN PATENT DOCUMENTS

| | | | |
|---|---|---|---|
| EP | 1 249 737 A2 | | 10/2002 |
| GB | 2202489 A | * | 9/1988 |
| JP | 58-54367 | | 3/1983 |
| JP | 63-150967 | | 6/1988 |
| JP | 63213858 A | * | 9/1988 |
| JP | 03036579 A | * | 2/1991 |
| JP | 05024315 A | * | 2/1993 |

(Continued)

OTHER PUBLICATIONS

U.S. Appl. No. 11/554,944, filed Oct. 31, 2006, Yano et al.

(Continued)

*Primary Examiner*—Robert Beatty
(74) *Attorney, Agent, or Firm*—Oblon, Spivak, McClelland, Maier & Neustadt, P.C.

(57) ABSTRACT

An auxiliary power supply unit, which is attachable to and detachable from an apparatus, includes a charge unit configured to store electric charge, a terminal configured to establish electrical connection for discharge with the apparatus, and a discharge unit situated between the charge unit and the terminal to provide a discharge path that electrically connect the charge unit to the apparatus, the discharge path having an open/closed state thereof controlled during a period when an electric power is supplied from the apparatus, the discharge path being opened in response to a stoppage of supply of the electric power from the apparatus.

12 Claims, 8 Drawing Sheets

FOREIGN PATENT DOCUMENTS

| | | | | |
|---|---|---|---|---|
| JP | 7-161385 | | | 6/1995 |
| JP | 07240238 | A | * | 9/1995 |
| JP | 10028334 | A | * | 1/1998 |
| JP | 10210665 | A | * | 8/1998 |
| JP | 2000134811 | A | * | 5/2000 |
| JP | 2000-315567 | | | 11/2000 |
| JP | 2001-66926 | | | 3/2001 |
| JP | 2003-32908 | | | 1/2003 |
| WO | WO 03/067930 | | | 8/2003 |

OTHER PUBLICATIONS

U.S. Appl. No. 11/522,324, filed Jul. 18, 2006, Semma et al.
Patent Abstracts of Japan, JP 63-113563, May 18, 1988.

* cited by examiner

AUXILIARY POWER SUPPLY UNIT AND IMAGE FORMING APPARATUS

BACKGROUND OF THE INVENTION

1. Field of the Invention

The present invention relates to an auxiliary power unit and image forming apparatus.

2. Description of the Related Art

Image forming apparatuses are provided with an image forming unit for forming a toner image on a record medium and a fuser unit or the like for fixing the toner image by pressing and heating the record medium on which the toner image is formed. The fuser unit includes fusing rollers for heating the record medium, and these fusing rollers are heated to a predetermined temperature by a heater. In so doing, the heater consumes a significant amount of power.

In image forming apparatuses, especially in high-speed image forming apparatuses, the electric power may sometimes be set to 200 V in order to obtain a high power. A commercial power typically used in offices in Japan is 100 V (15 A). In order to set the power of an image forming apparatus to 200 V, thus, a special electric work needs to be performed with respect to the power supply facility at the place where the image forming apparatus is installed. This is not convenient, and is not an effective way to cope with the situation.

Some image forming apparatuses thus use a 100-V power, and drop the speed of image formation or temporarily suspend the operation of image formation when the temperature of the fusing rollers drops to such temperature as to cause a failure of fusing due to the lack of electric power supply. This however reduces productivity. It should be noted that the time required for the fusing rollers to reach a predetermined temperature after the power-on is dependent on the capacity of the power supply. Because of this, the operation of image formation cannot be performed for a longer period of time until the fusing rollers reach a predetermined temperature than when a 200-V power is used. This is another factor to reduce the productivity.

[Patent Document 1]Japanese Patent Application Publication No. 58-54367

[Patent Document 2]Japanese Patent Application Publication No. 63-150967

[Patent Document 3]Japanese Patent Application Publication No. 2001-66926

In order to overcome the problem of the lowering of productivity, the technologies disclosed in Patent Document 1, Patent Document 2, and Patent Document 3 may be used.

Patent Document 1 discloses a technology in which a battery is provided as a built-in component in an image forming apparatus, and supplies power to the fuser unit when the temperature of the fusing rollers drops below a predetermined temperature at the time of consecutive copying, thereby eliminating a down time of the image forming apparatus.

Patent Document 2 discloses a technology in which a first heater driven by an alternating current power supply and a second heater driven by a battery charged by a charger are provided, thereby reducing a startup time of the fuser unit.

Patent document 3 discloses a technology in which an auxiliary power is provided detachably for the image forming apparatus, thereby preventing the leakage of the electrolytic solution of the secondary battery from damaging surrounding components.

More often than not, a commercial power supply is not only used for an image forming apparatus but also used for other office equipment attached thereto. In such cases, a large electric current may flow into the breaker at the time of power-on of the image forming apparatus or return from the power consumption mode, resulting in the severing of the breaker. In order to avoid such a problem, typically, the maximum power consumption of the image forming apparatus is specified in the operation manual, catalog, or the like.

Some users (clients) of image forming apparatuses may not feel inconvenience even if the speed of image formation drops at the time of consecutive image formation, or even if there is a break time in the image forming operation. Further, there may be users who do not mind even if the startup time is lengthy. Also, the problem of breaker severing may differ depending on the usage of power supply at user offices. Moreover, if an auxiliary power supply and associated control circuit are provided in an image forming apparatus as in a conventional configuration, an expensive price of the image forming apparatus becomes an issue.

Accordingly, in order to achieve price reduction with respect to image forming apparatuses, it is preferable to add an auxiliary power supply and control circuit or the like in such a manner as to conform to the user usage of the apparatus, user usage of the power supply, user needs, etc.

In this manner, it is desirable to select a balance between higher performance and lower price according to user needs, by providing a unitized structure of an auxiliary power supply and control circuit or the like such that the unit is detachable from the image forming apparatus.

In the case of a unitized structure of an auxiliary power supply and control circuit or the like, the power required by the image forming apparatus is large, so that safety in particular is of prime importance. A conventional unit detachable from an image forming apparatus poses danger if the terminals for electrical connection with the image forming apparatus are touched by a finger or the like after the unit is detached from the image forming apparatus.

Accordingly, there is a need for an auxiliary power supply unit that is safe, and also a need for an image forming apparatus configured such that the auxiliary power supply unit is detachable therefrom.

SUMMARY OF THE INVENTION

It is a general object of the present invention to provide an auxiliary power supply unit and image forming apparatus that substantially obviate one or more problems caused by the limitations and disadvantages of the related art.

To achieve these and other advantages in accordance with the purpose of the invention, the invention provides an auxiliary power supply unit, which is attachable to and detachable from an apparatus, and includes a charge unit configured to store electric charge, a terminal configured to establish electrical connection for discharge with the apparatus, and a discharge unit situated between the charge unit and the terminal to provide a discharge path that electrically connect the charge unit to the apparatus, the discharge path having an open/closed state thereof controlled during a period when an electric power is supplied from the apparatus, the discharge path being opened in response to a stoppage of supply of the electric power from the apparatus.

According to another aspect of the present invention, an image forming apparatus includes an auxiliary power supply unit, which is attachable to and detachable from a main body of the apparatus, the auxiliary power supply unit including a charge unit configured to store electric charge, a terminal configured to establish electrical connection for discharge with the main body of the apparatus, and a discharge unit situated between the charge unit and the terminal to provide a discharge path that electrically connect the charge unit to the main body of the apparatus, the discharge path having an open/closed state thereof controlled during a period when an electric power is supplied from the main body of the apparatus, the discharge path being opened in response to a stoppage of supply of the electric power from the main body of the apparatus.

According to at least one embodiment of the present invention, the auxiliary power supply unit is provided with the discharge unit that is controllably driven based on the electrical power supplied from the main body of the apparatus. Upon being detached from the main body of the apparatus, the discharge unit of the auxiliary power supply unit no longer receives the electric power, resulting in the discharge path being opened. In the auxiliary power supply unit, therefore, the discharge path is blocked so as to decouple, from the charge unit, the discharge terminal, which is provided for electrical connection with the main body of the apparatus. Physical contact with the terminal thus does not poser any danger.

According to at least one embodiment of the present invention, it is possible to provide an auxiliary power supply unit that is safe and also to provide an image forming apparatus to which such auxiliary power supply unit is attachable.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments of the present invention will be described with reference to the accompanying drawings.

Embodiment 1

A first embodiment of the present invention will be described with reference to FIG. 1 through FIG. 7.

An image forming apparatus according to this embodiment includes a plurality of photoconductors capable of carrying respective toner images corresponding to the color composition, and the toner images formed on these photoconductors are transferred one over another onto an intermediate transfer unit (e.g. an intermediate transfer belt), followed by further transferring the superimposed image onto a record medium such as a record sheet, thereby forming a multi-color image. Such color image forming apparatus may be a color copier, for example. It should be noted, however, that the image forming apparatus is not limited to a color copier, but may as well be a black-and-white copier, a color printer, a black-and-white printer, a facsimile device, a printing press, etc.

Figure 1:
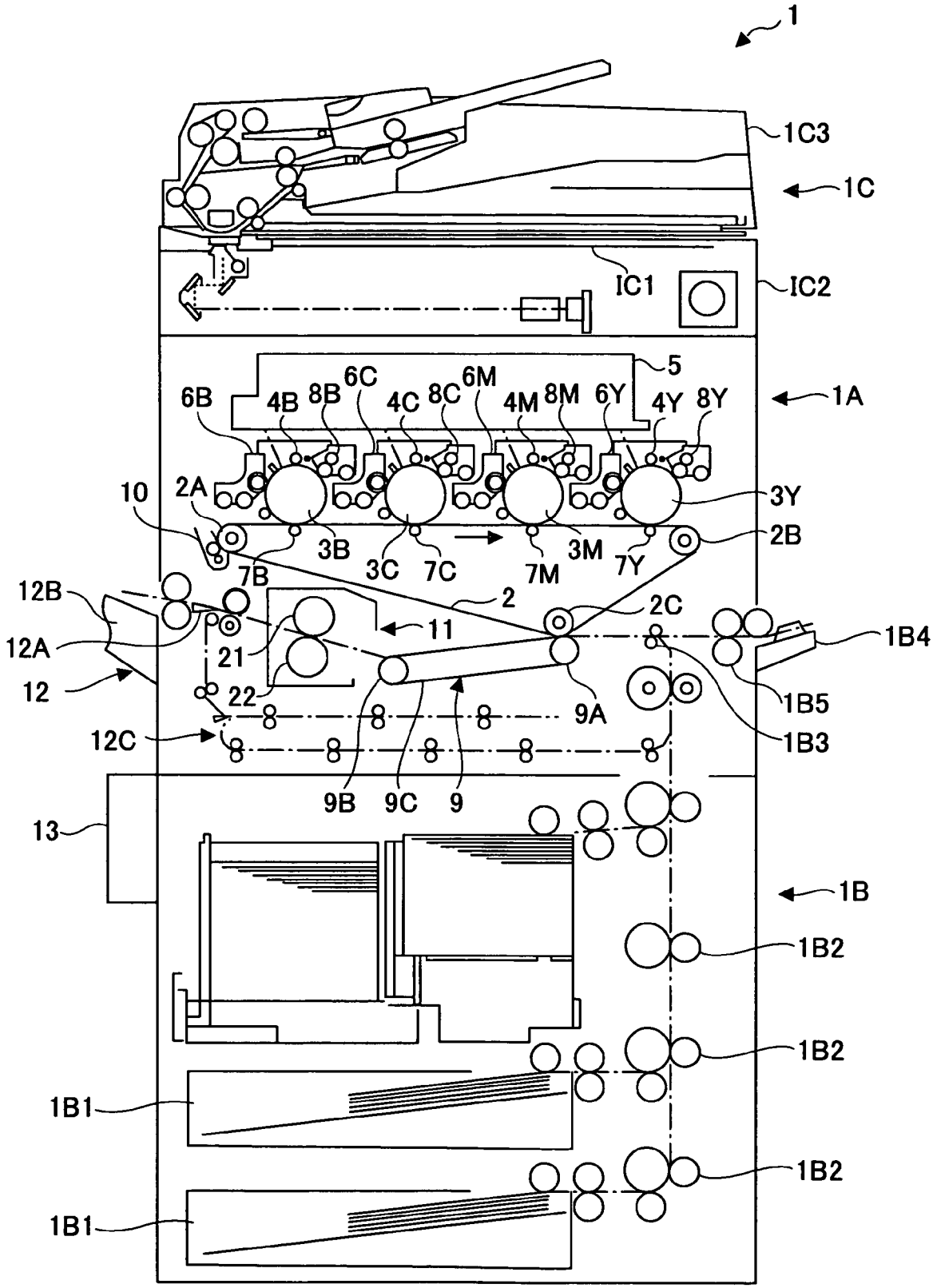
FIG. 1 is a cross-sectional side view showing a schematic configuration of a color image forming apparatus.

FIG. 1 is a cross-sectional side view showing a schematic configuration of a color image forming apparatus. As shown in FIG. 1, a color image forming apparatus 1 includes an image forming unit 1A provided at the center thereof, a sheet feeder unit 1B provided beneath the image forming unit 1A, and a document scan unit 1C provided over the image forming unit 1A.

The document scan unit 1C includes a scanner 1C2 having a document platform 1C1 on which a document is placed, and further includes an automatic document feeding unit 1C3 provided on the document platform 1C1. The scanner 1C2 scans document images (image information) from the document placed on the document platform 1C1. The automatic document feeding unit 1C3 supplies document sheets to the document platform 1C1, and is further configured to flip over the document sheets supplied to the document platform 1C1. This makes it possible to scan document images from both the front and back surfaces of the document sheets.

The image forming unit 1A includes an intermediate transfer belt 2 having a surface thereof extending in a horizontal direction, and further includes a plurality of photoconductors 3Y, 3M, 3C, and 3B, which are arranged along the extending surface of the intermediate transfer belt 2 and operable to carry respective toner images corresponding to the color separation colors and complementary colors (yellow, magenta, cyan, black).

The photoconductors 3Y, 3M, 3C, and 3B are formed in a drum shape, and are configured to rotate in the same direction (counterclockwise in FIG. 1). Around the photoconductors 3Y, 3M, 3C, and 3B are provided charging units 4Y, 4M, 4C and 4B, a writing unit 5, developing units 6Y, 6M, 6C, and 6B, primary transfer units 7Y, 7M, 7C, and 7B, and cleaning units 8Y, 8M, 8C, and 8B, which perform image forming processes during the rotation of the photoconductors 3Y, 3M, 3C, and 3B.

The charging units 4Y, 4M, 4C and 4B uniformly charge the surfaces of the photoconductors 3Y, 3M, 3C, and 3B, respectively. The writing unit 5 shines light beams on the photoconductors 3Y, 3M, 3C, and 3B to form electrostatic latent images in response to the image information obtained by the scanner 1C2 from a document placed on the document platform 1C1 or the image information supplied from a computer (not shown) connected to the color image forming apparatus 1.

The developing units 6Y, 6M, 6C, and 6B supply toner to the electrostatic latent images formed on the photoconductors 3Y, 3M, 3C, and 3B, respectively, thereby forming toner images on the surfaces thereof. The primary transfer units 7Y, 7M, 7C, and 7B transfer, to the intermediate transfer belt 2, the toner images formed on the surfaces of the photoconductors 3Y, 3M, 3C, and 3B, respectively. In so doing, the toner images of the photoconductors 3Y, 3M, 3C, and 3B are superimposed one over another on the intermediate transfer belt 2.

The intermediate transfer belt 2 is hooked around a plurality of rollers 2A, 2B, and 2C, and is configured to shift in the same direction at the positions where the photoconductors 3Y, 3M, 3C, and 3B are placed. The rollers 2A and 2B serve to provide the extending surface of the intermediate transfer belt 2. The remaining roller 2C is placed opposite a secondary transfer unit 9 across the intermediate transfer belt 2. Further, a cleaning unit 10 is provided at the position to face the intermediate transfer belt 2 so as to clean the intermediate transfer belt 2.

The secondary transfer unit 9 includes charging drive rollers 9A and 9B, and further includes a transfer belt 9C hooked around the charging drive rollers 9A and 9B to shift in the same direction as the intermediate transfer belt 2 at the secondary transfer position. The charging drive roller 9A charges the transfer belt 9C, thereby transferring, onto a sheet, a multi-color image superimposed on the intermediate transfer belt 2 or a monochrome image carried on the intermediate transfer belt 2

The sheet feeder unit 1B includes a plurality of sheet feeder cassettes 1B1 for storing sheets, a plurality of conveyer rollers 1B2 placed along the conveyer path to which the sheets are supplied from the sheet feeder cassettes 1B1, and a resist roller 1B3 situated upstream relative to the secondary transfer position (in terms of the sheet travel direction).

Further, the sheet feeder unit 1B includes a manual feed tray 1B4 provided as part of the side wall of the image forming unit 1A operable to flip open, and further includes a forwarding roller 1B5. With this provision, sheets placed on the manual feed tray 1B4 can be supplied to the secondary transfer position, separately from the conveyer path of the sheets supplied from the sheet feeder cassettes 1B1. The sheet conveyer path extending from the manual feed tray 1B4 merges into the sheet conveyer path extending between the sheet feeder cassettes 1B1 and the resist roller 1B3. Sheets coming from either conveyer path undergo resist timing setting by the resist roller 1B3.

A fuser unit 11 (the detail of which will later be described) for fixing a toner image on a sheet and an ejecting unit 12 for ejecting the sheet having the toner image fixed thereon are provided downstream relative to the secondary transfer unit (in terms of the sheet travel direction). Moreover, the color image forming apparatus 1 further includes a front door (not shown) for exposing the interior for the handling of jamming or the like, and a capacitor device 13 (the detail of which will later be described) for supplying an electric power to the fuser unit 11. The capacitor device 13 is configured such as to be detachable from the color image forming apparatus 1.

The ejecting unit 12 includes a conveyer path switching claw 12A for switching the sheet conveyer directions, a sheet ejection tray 12B onto which sheets are ejected, and a reversing conveyer path 12C for reversing the front side and back side of a sheet for use in duplex printing. The ejecting unit 12 uses the conveyer path switching claw 12A to switch the sheet conveyer directions so as to convey the sheet passing through the fuser unit 11 either to the conveyer path leading to the sheet ejection tray 12B or to the reversing conveyer path 12C.

In the color image forming apparatus 1 as described above, electrostatic latent images are formed on the photoconductors 3Y, 3M, 3C, and 3B that are uniformly charged, in response to the image information supplied from a document placed on the document platform 1C1 or in response to the image information supplied from a computer. The electrostatic latent images are then visualized by the developing units 6Y, 6M, 6C, and 6B, followed by transferring the toner images onto the intermediate transfer belt 2 through a primary transfer.

The toner images transferred onto the intermediate transfer belt 2 through a primary transfer are transferred through a secondary transfer onto a sheet supplied from the sheet feeder unit 1B. Such secondary transfer is done straight through in the case of a monochrome image, and is done by superimposing images through repeated primary transfers and by transferring the superimposed image onto the sheet in the case of a multi-color image. The sheet after the secondary transfer is treated by the fuser unit 11 to fuse the image onto the sheet. Thereafter, the sheet is supplied to the sheet ejection tray 12B or to the resist roller 1B3 again after the reversal thereof.

Figure 2:
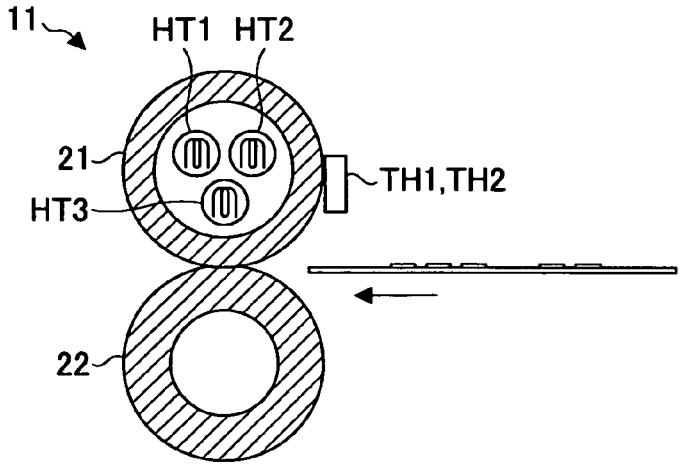
FIG. 2 is a cross-sectional side view showing a schematic configuration of a fuser unit.

FIG. 2 is a cross-sectional side view showing a schematic configuration of the fuser unit 11. As shown in FIG. 2, the fuser unit 11 includes a fusing roller 21 serving as a fusing member, a pressing roller 22 serving as a pressing member, and a pressing unit (not shown) for pressing the pressing roller 22 on the fusing roller 21 with a constant pressure. The fusing roller 21 and the pressing roller 22 are driven to rotate by a drive mechanism (not shown).

The fuser unit 11 includes three heaters HT1, HT2, and HT3, and further includes two temperature sensors TH1 and TH2 such as thermistors. The heaters HT1, HT2, and HT3 are situated inside the fusing roller 21, for example, to heat the fusing roller 21 from inside, thereby providing heat to the fusing roller 21. The temperature sensors TH1 and TH2 are placed in contact with the surface of the fusing roller 21, thereby detecting the surface temperature (fusing temperature) of the fusing roller 21. The temperature sensor TH1 is positioned in a measurement area corresponding to the heater HT1 and the heater HT2. The temperature sensor TH2 is positioned in a measurement area corresponding to the heater HT3.

The heaters HT1 and HT2 are main heaters for heating the fusing roller 21, and are turned on when the temperature of the fusing roller 21 is below a target temperature. The heater HT3 is turned on at the time of warming up of the fuser unit 11 such as when the main power of the color image forming apparatus 1 is turned on or when a startup operation is performed to make copying available after the "off" mode for energy conservation. The heater HT3 is also turned on when the temperature of the fusing roller 21 is below the target temperature at the time of image formation. The heater HT3 is an auxiliary heater for heating the fusing roller 21.

In the fuser unit 11 as described above, a sheet having a toner image thereon passes through a nip portion between the fusing roller 21 and the pressing roller 22. At the time of the passing, the fusing roller 21 and the pressing roller 22 apply heat and a pressure. As a result, the toner image is fixed on (fused with) the sheet.

Figure 3:
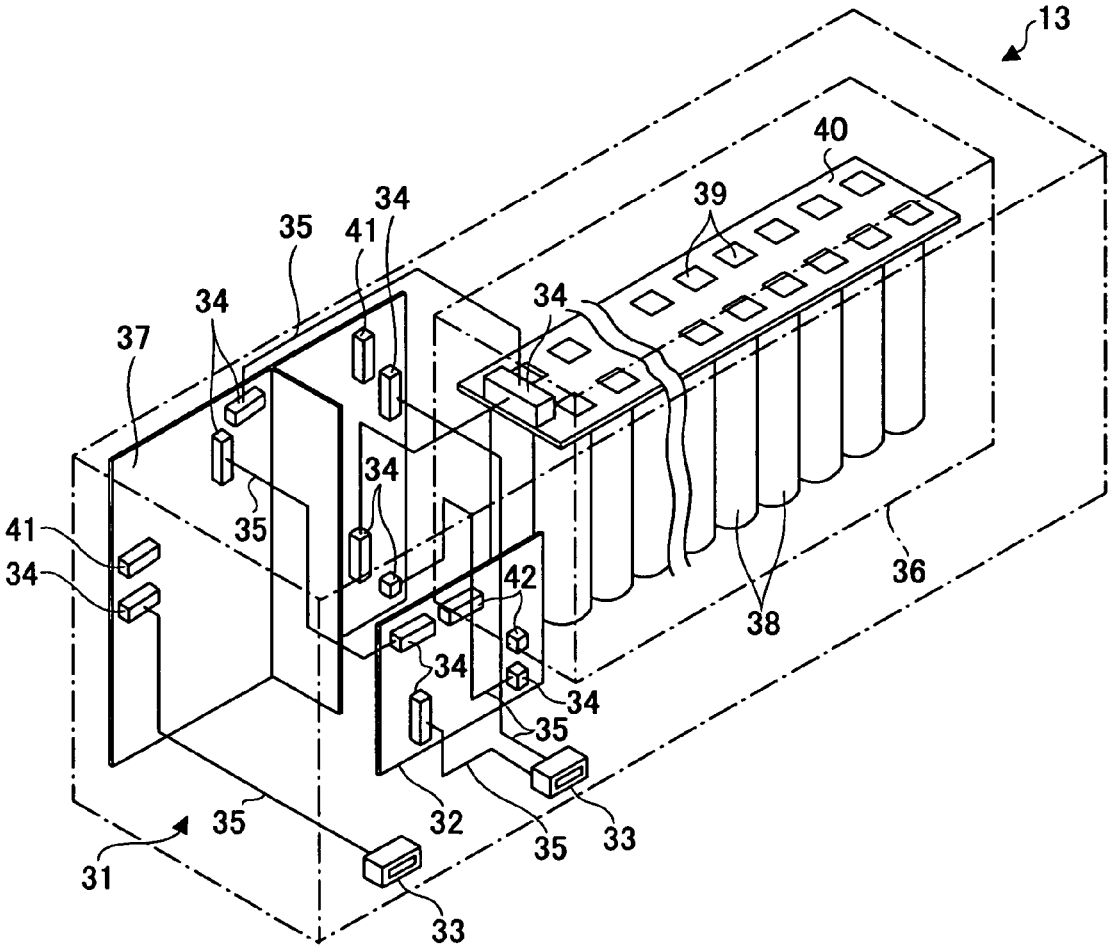
FIG. 3 is an exterior perspective view showing a schematic configuration of a capacitor device.

FIG. 3 is an exterior perspective view showing a schematic configuration of the capacitor device 13. As shown in FIG. 3, the capacitor device 13 includes a capacitor unit 31 and a capacitor control unit 32 for controlling parts of the capacitor unit 31. Further provided are drawer connectors 33 for providing electrical couplings with the color image forming apparatus 1. The capacitor unit 31 and the capacitor control unit 32 are coupled to each other via coupling connectors 34 and electrical wires 35.

The capacitor unit 31 includes a capacitor bank 36, a discharge unit 37, and a capacitor charging unit (not shown). The capacitor bank 36 is coupled to the discharge unit 37 and the capacitor charging unit via the coupling connectors 34 and the electrical wires 35. The capacitor control unit 32 drives and controls the discharge unit 37.

The capacitor bank 36 includes a plurality of capacitor cells 38 connected in series and a balance circuit board 40 having a plurality of balance circuits 39 for uniformly charging the respective capacitor cells 38. As the capacitor cells 38, electric double-layer capacitors for storing electric power are used, for example.

The capacitor charging unit includes charging units (not shown) for charging the plurality of capacitor cells 38 connected in series. The discharge unit 37 includes a discharge unit (not shown) serving as a supply unit for supplying the electric power charged (stored) in the capacitor cells 38 to the fuser unit 11, i.e., to the heater HT3, and further includes relay connectors 41 or the like for connecting a plurality of capacitor units 31. The capacitor control unit 32 also includes expansion connectors 42 for connecting a plurality of capacitor units 31.

According to this embodiment, the capacitor unit 31 is provided with the discharge unit 37 and the capacitor charging unit separate from each other. This is not a limiting example. For example, a charging/discharging unit may be provided. Alternatively, the capacitor unit 31 may be provided only with the discharge unit 37. In such a case, a capacitor charging unit 59 is provided as a built-in component in the color image forming apparatus 1.

The capacitor device 13 as described above is provided as a unitized structure detachable from the color image forming apparatus 1. The capacitor device 13 may be fixed to the color image forming apparatus 1 via screws or the like, and is electrically coupled to the color image forming apparatus 1 via the drawer connectors 33. The drawer connectors 33 of the capacitor device 13 are connected to the drawer connectors (not shown) of the color image forming apparatus 1, thereby providing electrical coupling between the capacitor control unit 32 and the color image forming apparatus 1. The drawer connectors 33, coupling connectors 34, electrical wires 35, and so on serve as an output means.

Figure 4:
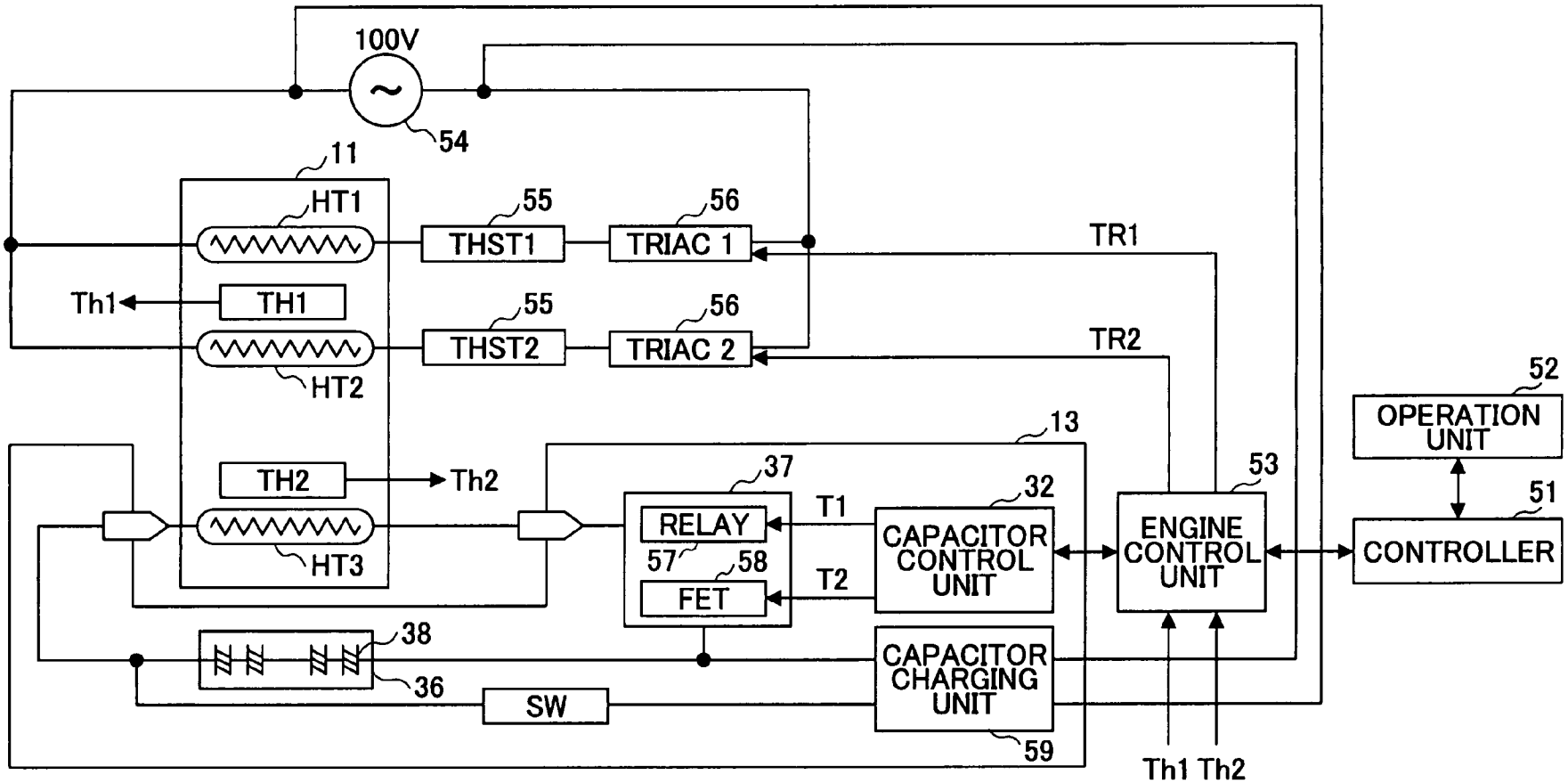
FIG. 4 is a block diagram showing a schematic configuration of electrical connections of individual parts of the color image forming apparatus in which the capacitor device is provided.

FIG. 4 is a block diagram showing a schematic configuration of electrical connections of each part of the color image forming apparatus 1 in which the capacitor device 13 is provided.

As shown in FIG. 4, the color image forming apparatus 1 includes a controller 51 for performing overall control, an operation unit 52 coupled to the controller 51, and an engine control unit 53 serving as an image formation controlling unit. The engine control unit 53 is coupled to the capacitor control unit 32 of the capacitor device 13 via a serial interface (UART).

The controller 51 includes a CPU (not shown), a ROM (not shown) for storing various programs executed by the CPU, and a RAM (not shown) serving as a work memory for use by the CPU, and implements the functions of a plurality of applications such as a scanner application, facsimile application, printer application, copy application, etc. The controller 51 attends to the overall control of the system. The operation unit 52 includes an operation panel, LCD, and the like (not shown). The operation unit 52 receives instructions from an operator, and displays settings and statuses to the operator. The engine control unit 53 includes a CPU, ROM, RAM, and the like (not shown), and mainly controls the image forming unit 1A and the fuser unit 11.

The fuser unit 11 includes three heaters HT1, HT2, and HT3. The heaters HT1 and HT2 are implemented as AC heaters. The heater HT3 is implemented as a DC heater.

The heaters HT1 and HT2 are coupled to an AC power supply (commercial power supply) 54 via triacs (TRIAC1 and TRIAC2) 56 and thermostats (THST1 and THST2) 55 for the prevention of overheating. Electric power is supplied via this path.

The heaters HT1 and HT2 are connected in series to the respective thermostats 55 for overheating prevention. The heaters HT1 and HT2 are controlled individually as to their on/off states by the triacs 56 based on the on/off signals TR1 and TR2, respectively, supplied from the engine control unit 53.

An output signal Th1 from the temperature sensor TH1 is supplied to an A/D converter (not shown) of the engine control unit 53. The CPU of the engine control unit 53 detects the temperature of the fusing roller 21 based on the input signal Th1 from the temperature sensor TH1, and supplies the on/off signals TR1 and TR2 to the triacs 56. With this provision, the temperature control of the fusing roller 21 is performed.

The heater HT3 is coupled to the capacitor device 13, i.e., to the capacitor bank 36 comprised of the capacitor cells 38 connected in series. The heater HT3 is controlled as to its on/off states by the discharge relay 57 and discharge FET 58 of the discharge unit 37. Namely, the discharge unit 37 supplies a direct current electric power to the heater HT3 from the capacitor cells 38 to make the heater HT3 generate heat ("heater on").

The capacitor cells 38 are coupled to the AC power supply 54 via the capacitor charging unit 59. The capacitor charging unit 59 of the capacitor device 13 receives an electric power from the AC power supply 54 to charge the plurality of capacitor cells 38.

The output signal Th2 from the temperature sensor TH2 is supplied to the A/D converter of the engine control unit 53. The CPU of the engine control unit 53 detects the temperature of the fusing roller 21 based on the input signal Th2 from the temperature sensor TH2, and supplies on/off signals T1 and T2 for provision to the discharge relay 57 and the discharge FET 58 to the capacitor control unit 32 via the serial interface. The capacitor control unit 32 supplies the on/off signals T1 and T2 to the discharge unit 37 for provision to the discharge relay 57 and the discharge FET 58, respectively. With this provision, the temperature control of the fusing roller 21 is performed.

The capacitor control unit 32 and the engine control unit 53 are coupled to each other via a photo-coupler. The photo-coupler is provided because of the large voltage of the capacitor bank 36, and improves noise-related performance and voltage-related performance. When the voltage of the capacitor bank 36 needs to be monitored, for example, the engine control unit 53 makes the capacitor control unit 32 monitor the voltage by use of control commands. Since the engine control unit 53 does not directly monitor the voltage of the capacitor bank 36, the noise-related performance and voltage-related performance are improved.

Figure 6:
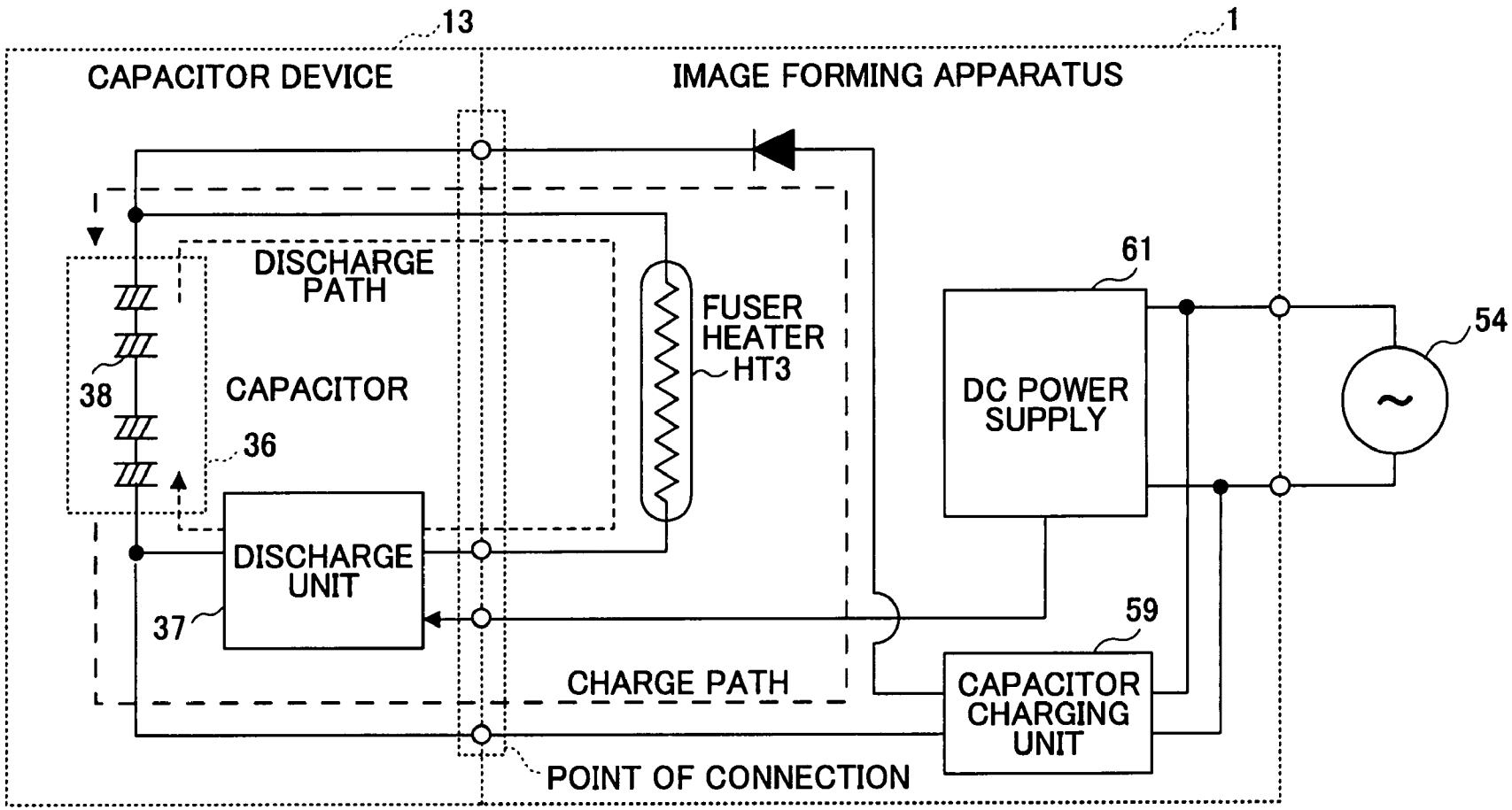
FIG. 6 is a block diagram showing an example of the schematic configuration of electrical connections between the capacitor device and various units provided in the color image forming apparatus.
Figure 7:
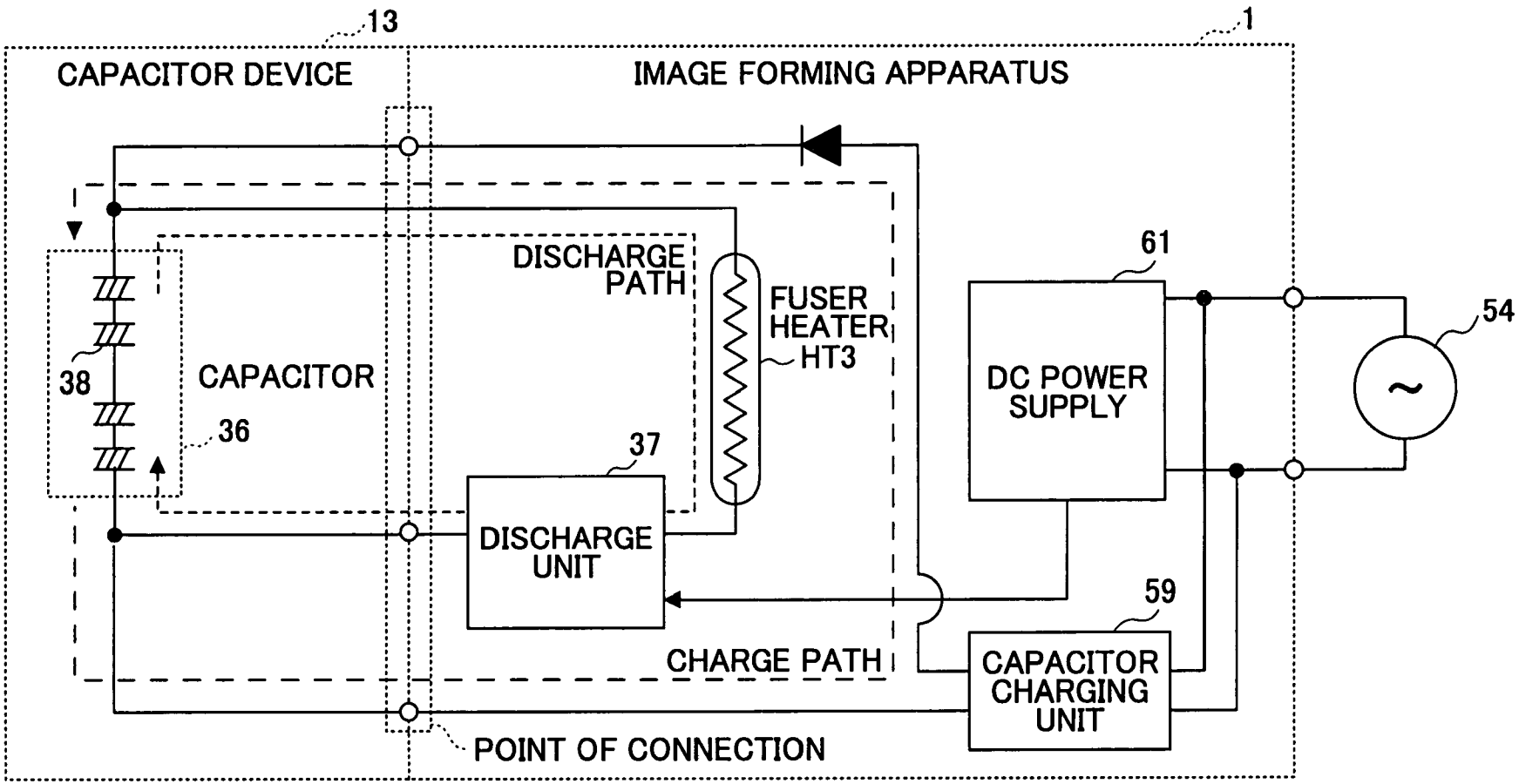
FIG. 7 is a block diagram showing an example of the schematic configuration of electrical connections between the capacitor device and various units provided in the color image forming apparatus.

The schematic configuration of the capacitor device 13 shown in FIG. 4 is merely an example. As shown in schematic configurations illustrated in FIG. 5 through FIG. 7, various units of the capacitor device 13 shown in FIG. 4 may alternatively be provided on the side of the color image forming apparatus 1. The schematic configurations of FIG. 5 through FIG. 7 illustrate only a relevant portion of the schematic configuration of FIG. 4 necessary for the explanation purpose.

Figure 5:
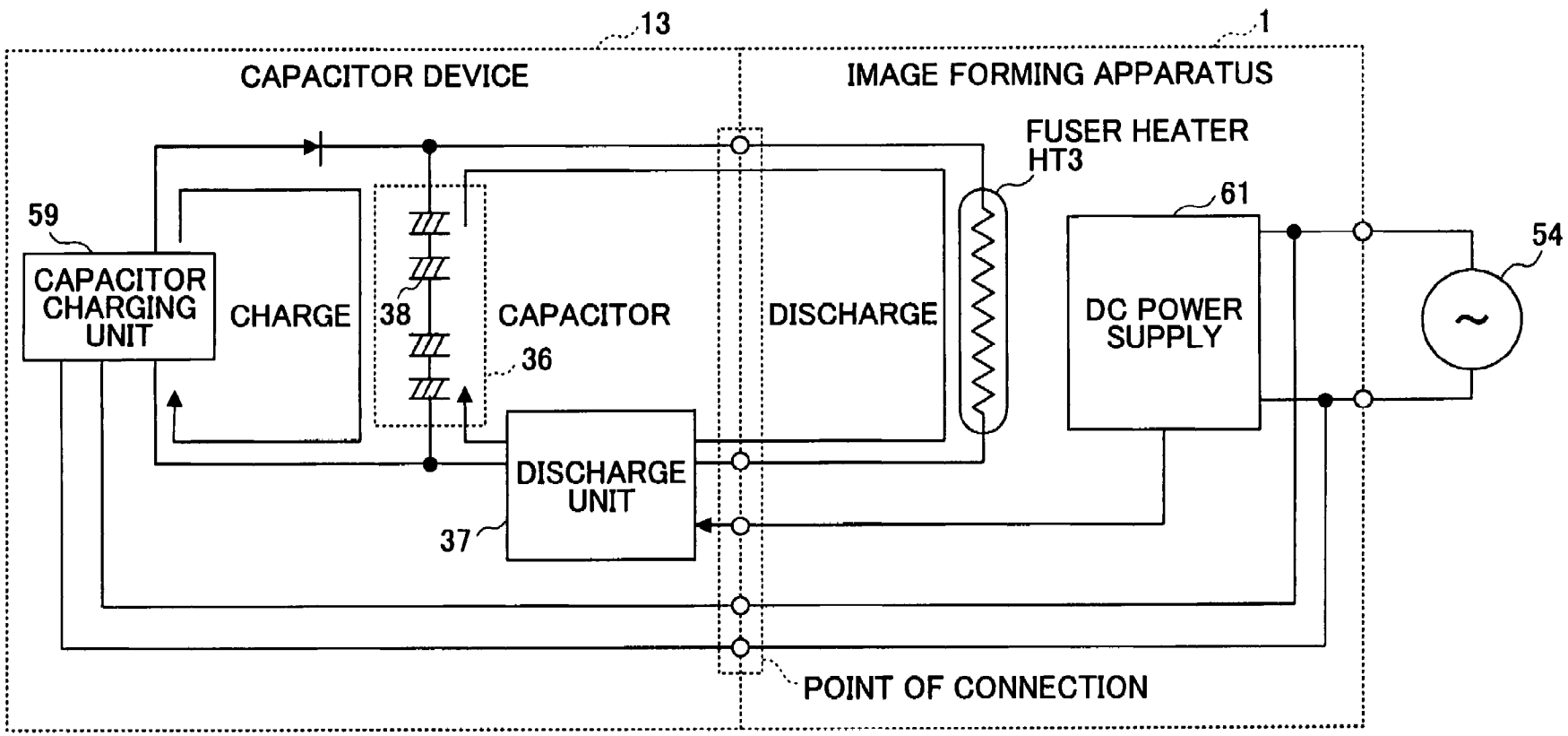
FIG. 5 is a block diagram showing an example of the schematic configuration of electrical connections between the capacitor device and various units provided in the color image forming apparatus.

FIG. 5 is a block diagram showing an example of the schematic configuration of electrical connections between the capacitor device 13 and various units provided in the color image forming apparatus 1. The schematic configuration of FIG. 5 illustrates a structure corresponding to the schematic configuration of FIG. 4.

In the schematic configuration of FIG. 5, the color image forming apparatus 1 is provided with a DC power supply 61 and the like. The DC power supply 61 is coupled to the AC power supply 54. The discharge unit 37 of the capacitor device 13 operates based on the power supplied from the DC power supply 61. The capacitor bank 36 of the capacitor device 13 is coupled to the AC power supply 54 via the capacitor charging unit 59. The capacitor charging unit 59 receives an electric power from the AC power supply 54 to charge the plurality of capacitor cells 38.

The discharge unit 37 is opened or closed under the drive control of the capacitor control unit 32 shown in FIG. 4. When the discharge unit 37 is closed, the electric power charged in the capacitor cells 38 is supplied to the heater HT3. When the discharge unit 37 is opened, the electric power charged in the capacitor cells 38 is not supplied to the heater HT3.

When the capacitor device 13 is detached from the color image forming apparatus 1, the discharge unit 37 is opened since the power supply from the DC power supply 61 is stopped. As a result, the discharge path of the capacitor device 13 is blocked. In the capacitor device 13, thus, the terminals (points of connection) for discharge and electrical connection with the color image forming apparatus 1 are separated from the capacitor cells 38. Physical contact with these terminals thus does not pose any danger.

FIG. 6 is a block diagram showing an example of the schematic configuration of electrical connections between the capacitor device 13 and various units provided in the color image forming apparatus 1. In the schematic configuration of FIG. 6, the capacitor charging unit 59, which is provided in the capacitor device 13 in the schematic configuration of FIG. 5, is provided in the color image forming apparatus 1.

In the schematic configuration of FIG. 6, the color image forming apparatus 1 is provided with the capacitor charging unit 59, the DC power supply 61, and the like. The discharge unit 37 of the capacitor device 13 operates based on the power supplied from the DC power supply 61. The capacitor bank 36 of the capacitor device 13 is coupled to the AC power supply 54 via the capacitor charging unit 59 of the color image forming apparatus 1. The capacitor charging unit 59 receives an electric power from the AC power supply 54 to charge the plurality of capacitor cells 38.

The discharge unit 37 is opened or closed under the drive control of the capacitor control unit 32 shown in FIG. 4. When the discharge unit 37 is closed, the electric power charged in the capacitor cells 38 is supplied to the heater HT3. When the discharge unit 37 is opened, the electric power charged in the capacitor cells 38 is not supplied to the heater HT3.

When the capacitor device 13 is detached from the color image forming apparatus 1, the discharge unit 37 is opened since the power supply from the DC power supply 61 is stopped. As a result, the discharge path of the capacitor device 13 is blocked. In the capacitor device 13, thus, the terminals (points of connection) for discharge and electrical connection with the color image forming apparatus 1 are separated from the capacitor cells 38. Physical contact with these terminals thus does not pose any danger.

FIG. 7 is a block diagram showing an example of the schematic configuration of electrical connections between the capacitor device 13 and various units provided in the color image forming apparatus 1. In the schematic configuration of FIG. 7, the discharge unit 37 and the capacitor charging unit 59, which are provided in the capacitor device 13 in the schematic configuration of FIG. 5, are provided in the color image forming apparatus 1.

In the schematic configuration of FIG. 7, the color image forming apparatus 1 is provided with the discharge unit 37, the capacitor charging unit 59, the DC power supply 61, and the like. The DC power supply 61 is coupled to the AC power supply 54. The discharge unit 37 operates based on the power supplied from the DC power supply 61. The capacitor bank 36 of the capacitor device 13 is coupled to the AC power supply 54 via the capacitor charging unit 59 of the color image forming apparatus 1. The capacitor charging unit 59 receives an electric power from the AC power supply 54 to charge the plurality of capacitor cells 38.

The discharge unit 37 is opened or closed under the drive control of the capacitor control unit 32 shown in FIG. 4. When the discharge unit 37 is closed, the electric power charged in the capacitor cells 38 is supplied to the heater HT3. When the discharge unit 37 is opened, the electric power charged in the capacitor cells 38 is not supplied to the heater HT3.

When the capacitor device 13 is detached from the color image forming apparatus 1, the terminals (points of connection) of the capacitor device 13 for discharge and electrical connection with the color image forming apparatus 1 are not separated from the capacitor cells 38. As a result, the voltage of the capacitor bank 36 appears at these terminals, and physical contact with these terminals may result in an electrical shock.

As described above, the schematic configurations shown in FIG. 5 and FIG. 6 are safer than the schematic configuration shown in FIG. 7. In this manner, the present embodiment provides an auxiliary power supply unit that is safe. In this auxiliary power supply unit, the discharge path is automatically blocked after the unit is detached from the color image forming apparatus 1, so that physical contact with the terminals of the unit for electrical connection with the color image forming apparatus 1 does not pose any danger.

Further, according to the present embodiment, the capacitor device 13 is implemented as an independent and separate module. With this configuration, it is easy to change the amount of power supply in the color image forming apparatus 1 by selectively attaching or detaching the capacitor device 13. This makes it possible to adjust performance (e.g., CPM: the copy speed indicative of the number of copied sheets per minute) by adjusting the amount of electric power of the auxiliary power supply according to the user usage of apparatus, the user usage of power supply, user needs, etc.

When the capacitor device 13 inclusive of the capacitor control unit 32 and the discharge unit 37 and the like is provided as an independent module, there is no need to provide the capacitor control unit 32, the discharge unit 37, and the like in the color image forming apparatus 1. This achieves price reduction with respect to the color image forming apparatus 1.

Embodiment 2

A second embodiment of the present invention will be described with reference to FIG. 8.

This embodiment basically has the same configuration as the first embodiment. In the following, a description will be given of portions where the present embodiment differs from the first embodiment. In this embodiment, the same portions as those described in the first embodiment are referred to by the same numerals, and a description thereof will be omitted.

Figure 8:
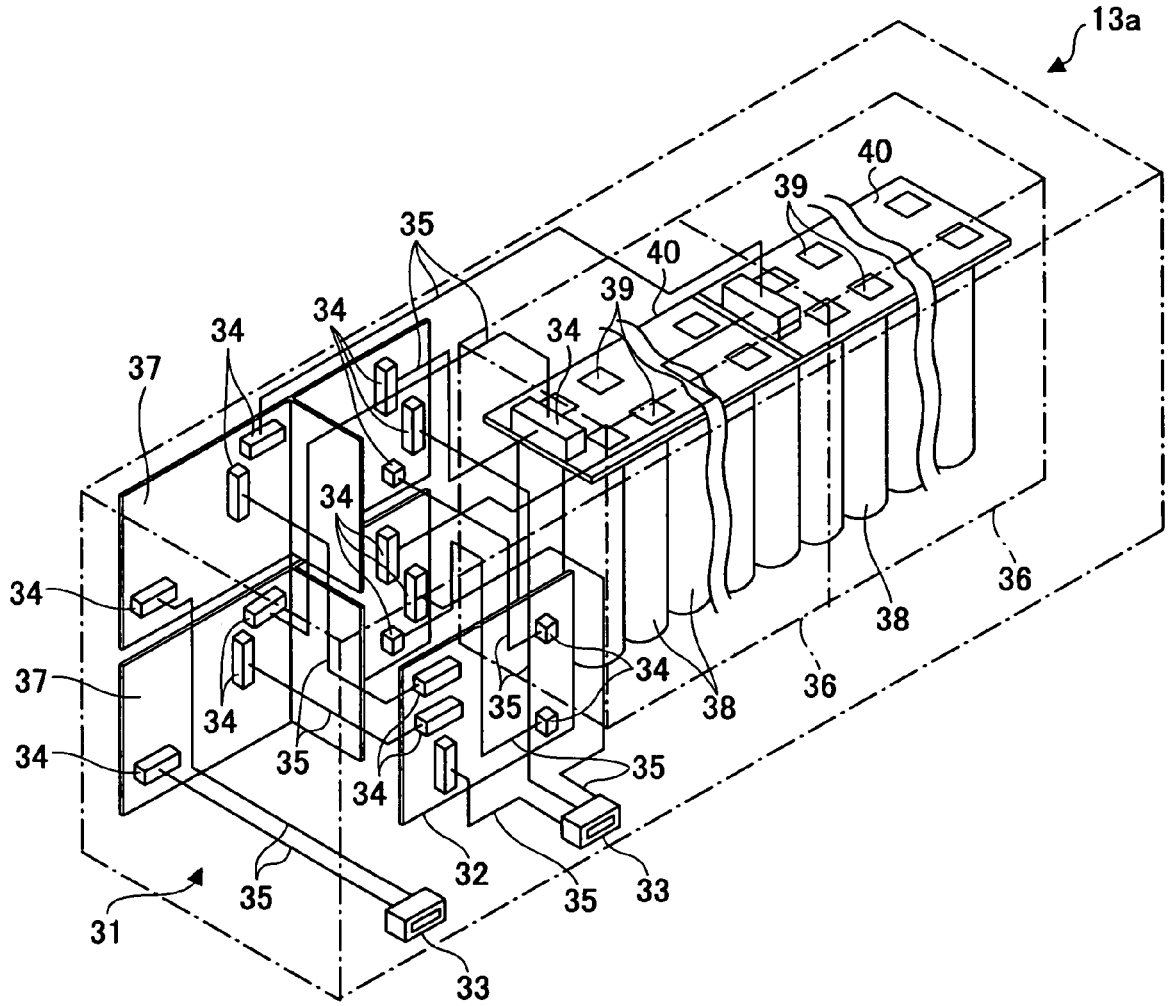
FIG. 8 is an exterior perspective view showing the schematic configuration of a capacitor device.

FIG. 8 is an exterior perspective view showing the schematic configuration of a capacitor device 13*a*. The capacitor device 13*a* of FIG. 8 includes two capacitor banks 36, and also includes two discharge units 37. The two capacitor banks 36 are coupled to the two discharge units 37, respectively. The two discharge units 37 are coupled to the capacitor control unit 32. The exchange of signals between the discharge units 37 and the capacitor control unit 32 is the same as in the first embodiment.

In the capacitor device 13*a*, the two capacitor banks 36 may be connected in series, for example. According to this embodiment as described above, the provision of the two capacitor banks 36 makes it easier to change the amount of electric power of the auxiliary power supply. With this provision, it is possible to adjust performance by adjusting the amount of electric power of the auxiliary power supply according to the user usage of apparatus, the user usage of power supply, user needs, etc.

When the capacitor device 13 inclusive of the capacitor control unit 32 and the discharge unit 37 and the like is provided as an independent module, there is no need to provide the capacitor control unit 32, the discharge unit 37, and the like in the color image forming apparatus 1. This achieves price reduction with respect to the color image forming apparatus 1.

In the present embodiment, the two capacitor banks 36 are connected in series. This is not a limiting example, and the two capacitor banks 36 may alternatively be connected in parallel. When the two capacitor banks 36 are connected in series, a higher voltage is necessary to charge the capacitor cells 38.

When the capacitor banks 36 are connected in parallel, also, the capacity of the power supply needs to be large in order to charge the capacitor cells 38. Achieving this requires an expensive capacitor charging unit 59. As in the present embodiment, thus, it is preferable to provide the capacitor charging unit 59 separately for each capacitor bank 36.

Embodiment 3

A third embodiment of the present invention will be described with reference to FIG. 9. This embodiment has a configuration in which capacitor devices each identical to the capacitor device 13 of the first embodiment are connected in series. In the following, a description will be given of portions where the present embodiment differs from the first embodiment. In this embodiment, the same portions as those described in the first embodiment are referred to by the same numerals, and a description thereof will be omitted.

Figure 9:
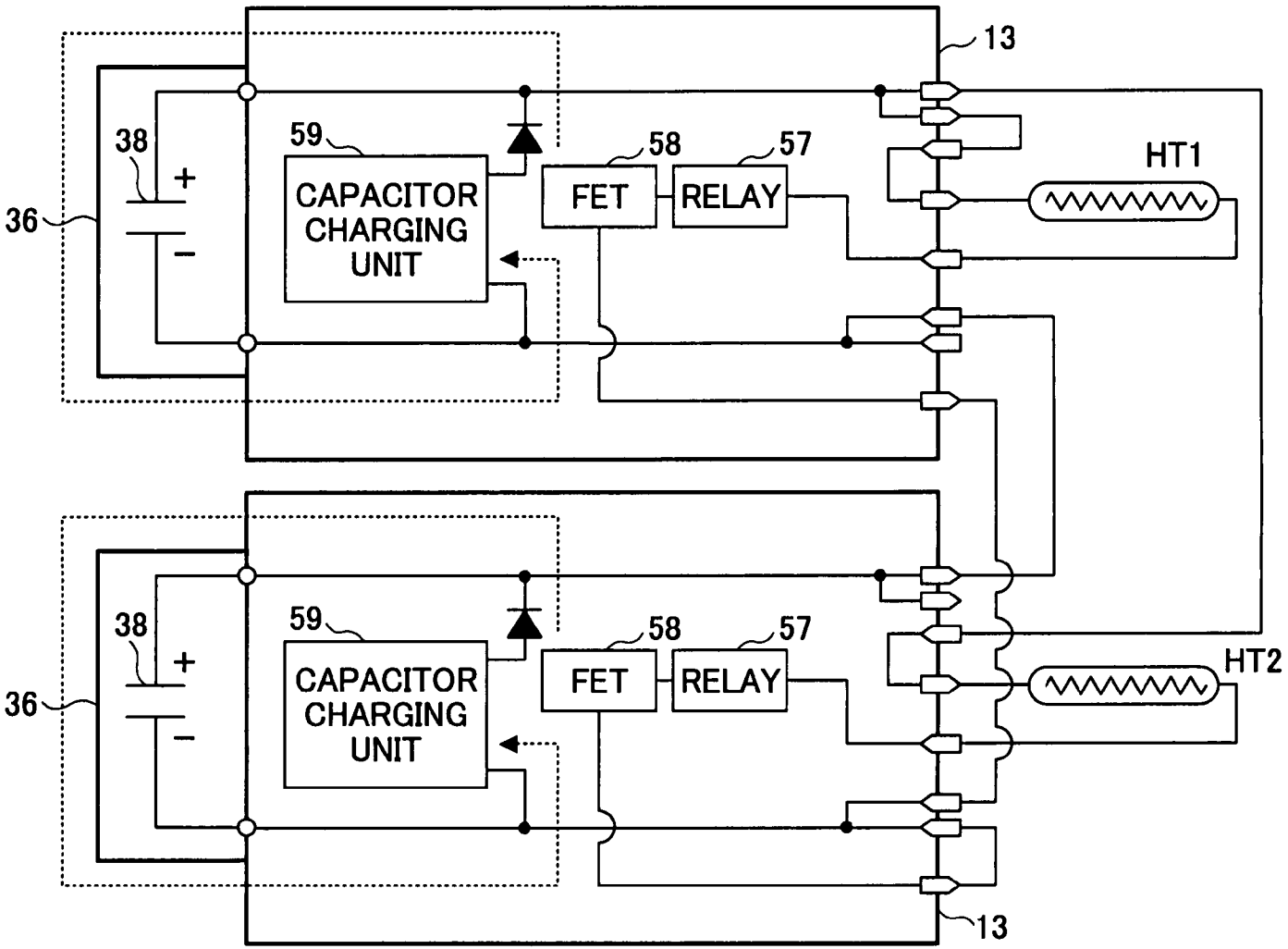
FIG. 9 is a block diagram showing the schematic configuration of capacitor devices connected in series.

FIG. 9 is a block diagram showing the schematic configuration of capacitor devices 13 connected in series. The capacitor devices 13 shown in FIG. 9 are configured such that a single capacitor charging unit 59 is used to charge a single capacitor bank 36, and such that the two capacitor banks 36 are connected in series at the time of discharge, thereby providing twice as high voltage as the charging voltage. The two heaters HT1 and HT2 are connected in parallel to the two capacitor banks 36 that are connected in series. A separate discharge relay 57 and discharge FET 58 make it possible to perform separate, independent discharge operations.

According to the third embodiment, the capacitor device 13 is provided as an independent module, which makes it possible to change the amount of power supply of the auxiliary power supply by selectively attaching or detaching such a module. This makes it possible to reduce the price of the apparatus and also to adjust the performance by adjusting the amount of electric power of the auxiliary power supply according to the user usage of apparatus, the user usage of power supply, user needs, etc.

Further, the present invention is not limited to these embodiments, but various variations and modifications may be made without departing from the scope of the present invention.

The present application is based on Japanese priority application No. 2004-225619 filed on Aug. 2, 2004 and Japanese priority application No. 2005-202153 filed on Jul. 11, 2005, with the Japanese Patent Office, the entire contents of which are hereby incorporated by reference.

What is claimed is:

1. An auxiliary power supply unit, which is attachable to and detachable from an image forming apparatus that receives electric power from a commercial power supply and the auxiliary power supply unit, comprising:

a charge unit including one or more capacitors configured to store electric charge;

a terminal configured to establish electrical connection for discharge with the apparatus; and a discharge unit situated on a discharge path that is provided inside the auxiliary power supply unit to electrically connect between said charge unit and said terminal, said discharge path having an open/closed state thereof controlled to be open at one time and closed at another time during a period when the auxiliary power supply unit is attached to and receives an electric power based on the commercial power supply from a power supply unit of the image forming apparatus, said discharge path in the closed state thereof supplying an electric power from the charge unit to the image forming apparatus, said discharge path being opened in response to a stoppage of supply of the electric power that is based on the commercial power supply from the image forming apparatus when the auxiliary power supply unit is detached from the image forming apparatus.

2. The auxiliary power supply unit as claimed in claim 1, further comprising a charging unit configured to charge said charge unit based on the supply of the electric power from the apparatus.

3. The auxiliary power supply unit as claimed in claim 1, further comprising a control unit configured to control the open/closed state of the discharge path while the discharge unit is receiving the electric power from the apparatus.

4. The auxiliary power supply unit as claimed in claim 1, further comprising a plurality of balance circuits configured to equalize charged voltages of capacitor cells connected in series in said charge unit.

5. The auxiliary power supply unit as claimed in claim 1, further comprising a photo-coupler configured to provide an electrical coupling with the apparatus.

6. An image forming apparatus comprising an auxiliary power supply unit, which is attachable to and detachable from a main body of the apparatus, said main body of the apparatus receiving electric power from a commercial power supply and the auxiliary power supply unit, said auxiliary power supply unit comprising:

a charge unit including one or more capacitors configured to store electric charge;

a terminal configured to establish electrical connection for discharge with the main body of the image forming apparatus; and a discharge unit situated on a discharge path that is provided inside the auxiliary power supply unit to electrically connect between said charge unit and said terminal, said discharge path having an open/closed state thereof controlled to be open at one time and closed at another time during a period when the auxiliary power supply unit is attached to and receives an electric power based on the commercial power supply from a power supply unit of the main body of the image forming apparatus, said discharge path in the closed state thereof supplying an electric power from the charge unit to the image forming apparatus, said discharge path being opened in response to a stoppage of supply of the electric power that is based on the commercial power supply from the main body of the image forming apparatus when the auxiliary power supply unit is detached from the main body of the image forming apparatus.

7. The image forming apparatus as claimed in claim 6, further comprising a charging unit configured to charge said charge unit of said auxiliary power supply unit.

8. The image forming apparatus as claimed in claim 6, further comprising a control unit configured to control the open/closed state of the discharge path while the discharge unit of the auxiliary power supply unit is receiving an electric power.

9. The image forming apparatus as claimed in claim 6, wherein said auxiliary power supply unit further includes a plurality of balance circuits configured to equalize charged voltages of capacitor cells connected in series in said charge unit.

10. The image forming apparatus as claimed in claim 6, further comprising a photo-coupler configured to provide an electrical coupling between the auxiliary power supply unit and the main body of the apparatus.

11. The image forming apparatus as claimed in claim 6, further comprising:

a fuser unit configured to press and heat a record medium having a toner image formed thereon so as to fix the toner image;

a heating unit configured to heat said fuser unit; and a sensor unit configured to detect a temperature of said fuser unit, wherein said heating unit heats said fuser unit by use of an electric power discharged from said charge unit of said auxiliary power supply unit in response to the temperature of said fuser unit as detected by said sensor unit.

12. The image forming apparatus as claimed in claim 6, further comprising one or more secondary auxiliary power supply units each substantially identical to said auxiliary power supply unit, said auxiliary power supply unit and said one or more secondary auxiliary power supply units being connected in series and being attachable and detachable from the main body of the apparatus.

* * * * *